United States Patent [19]

Weiland et al.

[11] Patent Number: 4,787,118

[45] Date of Patent: Nov. 29, 1988

[54] VACUUM BRUSH DEVICE FOR CLEANING VENETIAN BLINDS

[76] Inventors: Herbert C. Weiland, 54 Avenida Corona, Rancho Palos Verdes, Calif. 90274; Bryan K. Honkawa, Jr., 561 Ida St., Pacific Palisades, Calif. 90272

[21] Appl. No.: 32,757

[22] Filed: Mar. 30, 1987

[51] Int. Cl.[4] ..... A47L 9/06

[52] U.S. Cl. ..... 15/394; 15/210 A

[58] Field of Search ..... 15/210 A, 394, 395, 15/396, 415 R, 354; 285/7; 403/92, 93, 329

[56] References Cited

U.S. PATENT DOCUMENTS

| | | | |
|---|---|---|---|
| 2,231,802 | 2/1941 | Diggs | 15/394 |
| 2,271,694 | 2/1942 | Johnson | 15/394 |
| 2,490,892 | 12/1949 | Westhoff | 15/394 |
| 2,611,917 | 9/1952 | Ventsias et al. | 15/394 |
| 2,652,583 | 9/1953 | Tomanica | 15/394 |
| 4,638,526 | 1/1987 | Murata et al. | 15/367 |
| 4,653,137 | 3/1987 | Fleischhauer | 15/374 |
| 4,718,141 | 1/1988 | Kuehnl | 15/394 |

FOREIGN PATENT DOCUMENTS

| | | | |
|---|---|---|---|
| 248580 | 12/1963 | Australia | 15/394 |

*Primary Examiner*—Harvey C. Hornsby
*Assistant Examiner*—Corinne M. Reinckens
*Attorney, Agent, or Firm*—Price, Gess & Ubell

[57] ABSTRACT

A vacuum brush device for cleaning slatted structures such as venetian blinds includes a hollow body member that can be attached to a source of vacuum such as a vacuum cleaner hose through a tubular connector. The tubular connector can be adjustably positioned. The hollow body member includes a plurality of elongated finger members having a napped surface for cleaning the blinds.

5 Claims, 1 Drawing Sheet

VACUUM BRUSH DEVICE FOR CLEANING VENETIAN BLINDS

BACKGROUND OF THE INVENTION

1. Field of the Invention

The present invention is for cleaning slatted structures such as venetian blinds and, more particularly, provides a vacuum brush device that can not only efficiently clean venetian blind structures but can be readily assembled in an economical manner.

2. Description of the Prior Art

Venetian blinds or slatted structures have been known for both decorative and functional features for windows. These structures have been frequently referred to as venetian blinds and today these structures are usually formed from thin, flexible sheets of metal that are usually referred to as mini-blinds. The value of these structures is readily appreciated in most households but they do create a cleaning problem in the accumulation of dust. This problem is well known and numerous vacuum cleaner attachments have been suggested in the past to address this cleaning chore. The patented literature discloses a crowded art of the following U.S. Pat. Nos. 2,231,802, 2,271,694, 2,276,078, 2,487,444, 2,490,892, 2,611,917, 2,663,046, 2,821,736, 2,845,736, 2,845,651, and 3,045,275. In general, each of these patents seek to provide a brush that is augmented by the suction of a vacuum cleaner to both brush dust off of the blinds and to capture the dust through the suction effect. A number of these structures are relatively complex and after frequent use can present a cleaning problem themselves.

Thus the prior art is still seeking an improved vacuum brush device for attachment to a vacuum cleaner to clean slatted structures such as mini-blinds.

SUMMARY OF THE INVENTION

A vacuum brush device for cleaning slatted structures such as mini-blinds and venetian blinds includes a plastic hollow body member consisting of two housing shells. Each of the housing shells can provide circular groove bearing surfaces at one end with biasing leaf springs. A tubular, hollow member having a pair of circular rims of complementary dimension can be captured by the groove bearing surfaces to provide a connection with the vacuum cleaner nozzle. The tubular, hollow member can also provide a pair of indents for contacting the leaf spring members to provide set positions of adjustment between the hollow body member and the vacuum cleaner nozzle. The other end of the hollow body member includes a series of slotted vertically aligned apertures that can friction mount individual elongated meniscus shaped finger members having an exterior nap surface on their upper and lower surfaces. Alternatively, the finger members can be permanently affixed. The finger members are spaced a distance slightly greater than the dimension of the thickness of the slatted structure to be cleaned so that the nap surfaces will contact and clean the slatted structure. Each of the elongated fingers has an elongated opening extending along the longitudinal axis of the fingers to assist in communicating the source of vacuum to the mini-blinds. The elongated finger members can be removably attached by the friction mounting to permit ready cleaning for the operator. The features of the present invention can be appreciated from the following specification and drawings.

The objects and features of the present invention which are believed to be novel are set forth with particularly independent claims. The present ivention, both as to its organization and manner of operation, together with further objects and advantages thereof, may best be understood by reference to the following description, taken in connection with the accompanying drawings.

DESCRIPTION OF THE PREFERRED EMBODIMENT

The following description is provided to enable any person skilled in the field of manufacturing cleaning devices to make and use the invention and sets forth the best mode contemplated for carrying out the invention. Various modifications, however, will remain readily apparent to those skilled in the above art, since the generic principles of the present invention have been defined herein specifically to provide a relatively economical and easily manufactured vacuum brush device.

Figure 1:
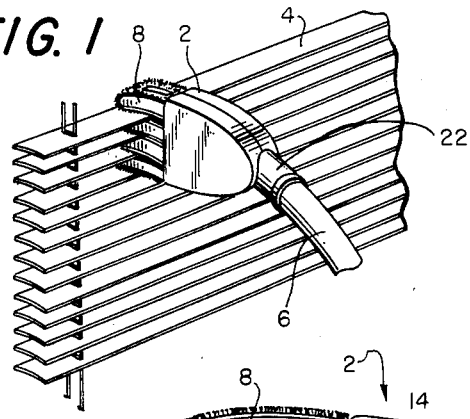
FIG. 1 is a perspective view of the vacuum brush device connected to the nozzle of a vacuum cleaner.
Figure 4:
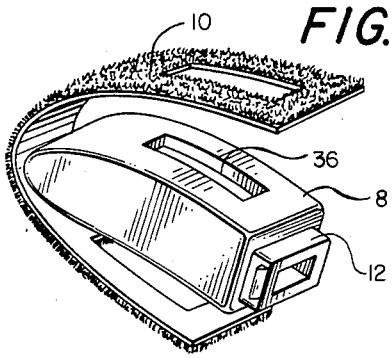
FIG. 4 is a respective partial exploded view of an elongated finger member and its nap surface structure.

Referring to FIG. 1, the vacuum brush device 2 is shown in a perspective view relative to a set of mini-blinds 4. The nozzle 6 of a vacuum cleaner hose provides the source of vacuum to the mini-blinds 4. As can be seen, the relative distances between elongated finger members 8 are slightly greater than the dimension of the thickness of the slatted mini-blind structure to be cleaned and are in the range of 4 to 5 mm. The finger members 8 are approximately 42 mm in length with curved surfaces of 60 mm in radius. Their height is about 16 mm with a width of about 18 mm. Each of the finger members 8 have their upper and lower curved surfaces covered with a fibrous napped material such as nylon to provide a nap surface as seen in FIG. 4. The napped material is closely packed and is similar in texture to the Velcro fasteners that engage the multiple hooks. This napped material 10 can be fastened by an adhesive to the upper and lower surfaces of the finger members 8.

Figure 2:
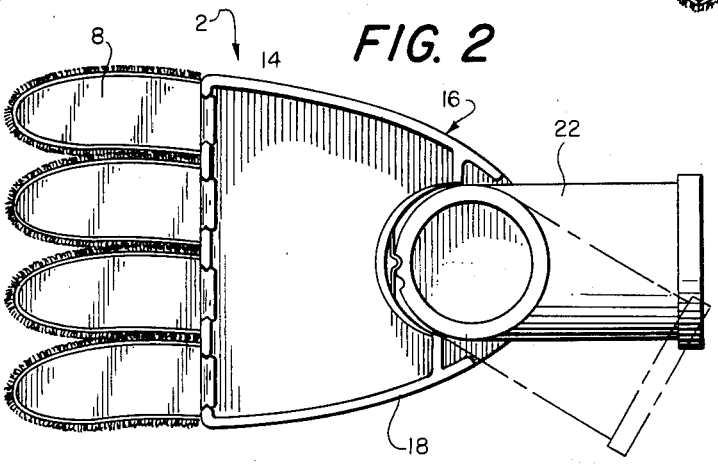
FIG. 2 is a partial plan view of the present invention.
Figure 5:
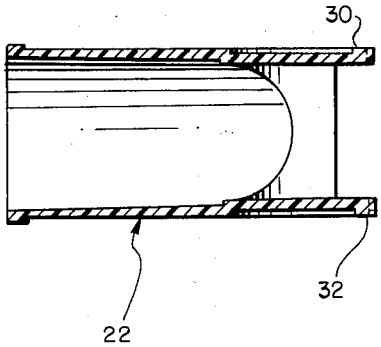
FIG. 5 is a cross-sectional view of a tubular connecting member.
Figure 6:
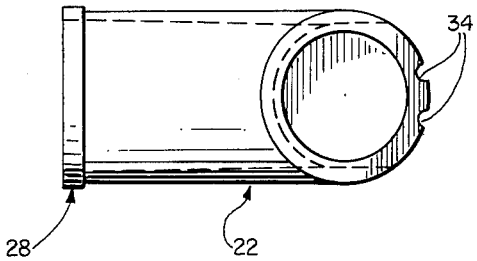
FIG. 6 is a side view of the tubular connecting member.

As can be seen in FIG. 2 and FIG. 4, each of the finger members 8 has a rectangular connector 12 that can be friction fitted through, for example, a snap lock design within complementary apertures 14 at one end of the hollow body member 16. The hollow body member 16 comprises two housing shells 18 and 20 that can be advantageously molded from a plastic material and then connected together by an appropriate adhesive. In an alternative embodiment, the finger members can be permanently affixed with adhesive to the body member 16. Each of the housing shells provide one-half of the apertures 14 that can friction hold the connectors 12 of the finger members 8 along one end of the body member 16. The other end of the hollow body member 16 can movably support a tubular hollow connector member 22, seen in FIGS. 5 and 6. The tubular connector 22 can provide a friction fit to the nozzle 6 of a vacuum cleaner hose directly or through an optional adapter (not shown).

Figure 3:
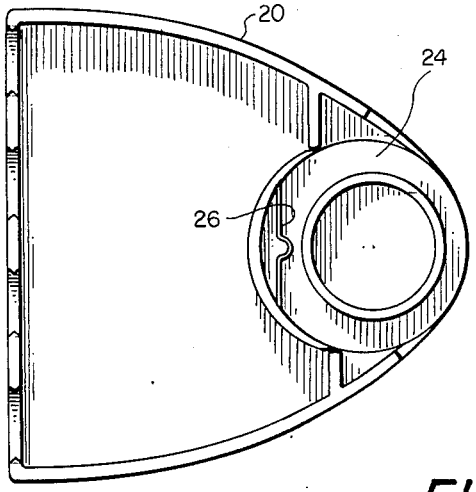
FIG. 3 is a plan view showing the other half of the hollow body member.

As can be seen in FIGS. 2 and 3, the interior of the housing shells 18 and 20 provide circular groove bearing surfaces 24 that can also mount notched leaf springs 26. The configuration of the tubular hollow connector 22 can be seen in FIGS. 5 and 6. One end of the tubular hollow connector member 22 provides an exterior rim 28 for both strength and ease of removal of the vacuum hose nozzle 6 from the tubular connector 22. The other end of the tubular connector 22 is affixed within the housing shells 18 and 20 and includes a pair of circular rims 30 and 32 of complementary dimensions to the groove bearing surfaces 24 of the housing shells. Thus, the tubular hollow connector 22 is mounted within the housing shells 18 and 20 for relative pivotal movement by its pair of circular rims 30 and 32. These circular rims also include respective indents 34 on each circular rim that can operatively interface with the notches on the respective leaf springs 26 to provide a pair of fixed positions for the relative adjustment of the vacuum brush device 2 with the nozzle 6 of the vacuum cleaner hose. These separate positions can be seen in the illustration of FIG. 2.

The hollow finger members 8 communicate with the hollow interior of the body member 16 to provide a communication of the vacuum source to elongated slots 36 on the upper and lower sides of the finger members 8. The remaining sides of the finger members 8 are flat and complement the flat sides of the housing shells 18 and 20. Since the finger members 8 can be friction fitted into the apertures 14 of the hollow body member 16, they can be readily removed for cleaning with a detergent in water. Thus, the vacuum brush device 2 of the present invention is not only efficient in cleaning slatted structures such as mini-blinds but it can also be cleaned itself to provide an appreciable extension of its useful life. The choice of a napped surface is made practical since it can be cleaned to remove any dust particles and debris that are not removed by the vacuum source and can, in effect, become a source of dirt itself.

As can be readily appreciated, the present invention provides an improved vacuum brush device, while permitting the manufacturer to enjoy a relatively easily manufactured and competitive product. The provision of separate finger members is of particular importance in lowering manufacturing cost. In view of the versatile capabilities of the present invention and the ability of people skilled in this field to creat variations once disclosed the generic principles of the present invention, the scope of the present invention should therfore by measured solely from the following claims.

What is claimed is:

1. A vacuum brush device for cleaning slatted structures such as venetian blinds comprising:

a hollow body member havng a curved side joined by a pair of flat side members with a plurality of rectangular openings aligned at one end opposite the curved side and adapted to be connected to a source of suction such as a vacuum cleaner hose;

a spring member;

means for connecting the body member to a source of suction including a tubular hollow member, the hollow body member has first and second housing portions, each housing portion has a bearing surface, and the tubular hollow member has a pair of circular rims of complementary dimensions to the bearing surfaces and a pair of indents for contacting the spring member to provide set positions for adjustment; and a plurality of elongated finger members having a hollow interior attached to and extending from the hollow body member, each finger member having an exterior napped surface on an upper and lower surface so that the napped surfaces extend between each of the finger members, the finger members being spaced at a distance slightly greater than the dimension of the thickness of the slatted structure to be cleaned whereby the napped surfaces will engage and clean the slatted structure, each of the elongated fingers having a rectangular connector and an elongated opening extending through the napped surface and communicating through the hollow exterior with the hollow body member to provide a source of suction between the fingers, the individual elongated finger members are mounted on the hollow body member through connection of the rectangular connectors in the rectangular openings of the hollow body member, the tubular hollow member is connected at one end of the hollow body member opposite the elongated finger members, and the tubular hollow member is movably mounted to permit relative adjustment of the hollow body member with the source of suction.

2. The vacuum brush of claim 1 wherein the elongated finger members have curved surfaces with flat sides.

3. The vacuum brush of claim 1 wherein the napped surfaces are a nylon fibrous material adhered to the exterior surfaces of the finger members.

4. A vacuum brush device for cleaning slatted structures such as venetian blinds, comprising;

a hollow body member adapted to be connected to a source of suction such as a vacuum cleaner hose;

means for connecting the body member to a source of suction;

a plurality of elongated meniscus shaped finger members having a hollow body member, each finger member having an exterior napped surface on a curved upper and lower surface so that the napped surfaces extend between each of the finger members, the finger members being spaced at a distance slightly greater than the dimension of the thickness of the slatted structure to be cleaned whereby the napped surfaces will engage and clean the slatted structure, each of the elongated fingers having an elongated opening extending through the napped surface and communicating through the hollow interior with the hollow body member to provide a source of suction between the fingers, the individual elongated finger members are mounted on the hollow body member to permit periodic cleaning of the napped surfaces, the connecting means includes a tubular hollow member that is connected at one end of the hollow body member opposite the elongated finger members, the tubular hollow member is movably mounted to permit relative adjustment of the hollow body member with the source of suction; and means for securing the hollow body member to one of a first and second set position of adjustment, wherein the hollow body member has first and second housing portions, each housing portion has a circular, grooved bearing surface and a spring member and the tubular hollow member has a pair of circular rims of complementary dimensions to the grooved bearing surfaces and a pair of indents for contacting the spring member to provide the set positions of adjustments.

5. The vacuum brush of claim 4 wherein the napped surfaces are a closely packed nylon fibrous material adhered to the exterior surfaces of the finger members.

* * * * *